US006835284B2

(12) United States Patent
Kornett

(10) Patent No.: US 6,835,284 B2
(45) Date of Patent: Dec. 28, 2004

(54) MONOFILAMENT LOW CALIPER ONE-AND-A-HALF LAYER SEAMED PRESS FABRIC

(75) Inventor: Glenn Kornett, Bonneau, SC (US)

(73) Assignee: Albany International Corp., Albany, NY (US)

( * ) Notice: Subject to any disclaimer, the term of this patent is extended or adjusted under 35 U.S.C. 154(b) by 35 days.

(21) Appl. No.: 10/334,164

(22) Filed: Dec. 30, 2002

(65) Prior Publication Data

US 2004/0127125 A1 Jul. 1, 2004

(51) Int. Cl.[7] ..... D21F 7/10; D21F 7/08; D03D 3/04

(52) U.S. Cl. ..... 162/358.2; 162/348; 162/900; 162/902; 162/903; 162/904; 139/383 A; 139/383 AA

(58) Field of Search ..... 162/203–207, 162/116, 117, 306, 348, 358.1, 358.2, 900–904; 138/393 A, 393 AA, 425; 28/110, 142; 442/270

(56) References Cited

U.S. PATENT DOCUMENTS

| | | | | |
|---|---|---|---|---|
| 5,103,874 A | * | 4/1992 | Lee | 139/383 A |
| 5,391,419 A | * | 2/1995 | Davenport | 428/193 |
| 5,458,161 A | * | 10/1995 | Scarfe | 139/383 AA |
| 5,613,527 A | | 3/1997 | Zimmermann et al. | |
| 6,273,146 B1 | | 8/2001 | Herring | |

* cited by examiner

*Primary Examiner*—Steven P. Griffin
*Assistant Examiner*—Eric Hug
(74) *Attorney, Agent, or Firm*—Frommer Lawrence & Haug LLP; Ronald R. Santucci

(57) ABSTRACT

A one-and-a-half layer monofilament fabric for use as a low-caliper seamed press fabric on a papermaking machine. The fabric is endless woven with seaming loops formed by adjacent unstacked MD wefts. The seaming loops are oriented perpendicular to the plane of the base fabric for easier connection and seaming. When the fabric is placed under load, the loops collapse back to produce a seam area having the same low caliper as the base fabric. Further, this unstacked fabric structure produces a larger web cake than other fabrics having a similar caliper.

5 Claims, 4 Drawing Sheets

TRIAL MODIFIED 1040MC Tissue SeamTech PATTERN

| 17 | 16 | 15 | 14 | 13 | 12 | 11 | 10 | 9 | 8 | 7 | 6 | 5 | 4 | 3 | 2 | 1 | | M |
|---|---|---|---|---|---|---|---|---|---|---|---|---|---|---|---|---|---|---|
| X | X | X | O | X | X | X | X | X | O | X | X | X | X | X | O | X | 1 | X |
| O | X | X | O | X | O | X | X | X | O | X | O | X | X | X | O | X | 2 | X |
| X | O | X | O | O | O | X | O | X | O | O | O | X | O | X | O | O | 3 | O |
| O | O | X | O | O | O | O | O | X | O | O | O | O | O | X | O | O | 4 | O |
| X | O | X | X | X | X | X | O | X | X | X | X | X | O | X | X | X | 5 | X |
| O | O | X | O | X | X | X | O | X | O | X | X | X | O | X | O | X | 6 | X |
| X | O | X | O | X | O | O | O | X | O | X | O | O | O | X | O | X | 7 | O |
| O | O | O | O | X | O | O | O | O | O | X | O | O | O | O | O | X | 8 | O |
| X | X | X | X | X | O | X | X | X | X | X | O | X | X | X | X | X | 9 | X |
| O | O | X | X | X | O | X | O | X | X | X | O | X | O | X | X | X | 10 | X |
| X | O | O | O | X | O | X | O | O | O | X | O | X | O | O | O | X | 11 | O |
| O | O | O | O | O | O | X | O | O | O | O | O | X | O | O | O | O | 12 | O |

FIG. 1

MONOFILAMENT LOW CALIPER ONE-AND-A-HALF LAYER SEAMED PRESS FABRIC

BACKGROUND OF THE INVENTION

1. Field of the Invention

The present invention relates to the papermaking arts. More specifically, the present invention relates to a monofilament low caliper one-and-a-half layer seamed press fabric for a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper. Press fabrics accept the large quantities of water extracted from the wet paper in the press nip. Hence, void volume is also important in press fabrics to provide a path for the water to go. The fabric must also have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on-machine-seamable. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt.

The present invention is directed to seamed press fabrics. Prior art seamed press fabrics typically consist of two MD yarn layers which form the seam loops in the finished fabric. Even when three MD layers are used, only two of the MD layers are used to form the seaming loops. In these prior art fabrics, various methods are employed to produce loops canted at an angle as perpendicular to the plane of the fabric body as possible. Perpendicular (or vertical) loops ease the process of loop connection and seaming when the fabric is installed in the field.

In cases requiring a low caliper fabric, a single layer seamed press fabric is used. However, with single layer fabric structures, the seam loops cannot be flattened to the caliper of the base fabric. In other words, in order to seam the fabric, the caliper in the loop area must be higher than in the base area. This caliper difference significantly restricts the range of applications for such fabrics since the larger seam caliper may cause operational problems with the paper machine. In addition, single layer structures have a low number of loops per linear area which results in a seam having a relatively lower strength when compared to double layer fabric seams.

Therefore, a need exists for a seamed press fabric for use in applications where a low caliper fabric is desired.

Another aspect of such a seamed press fabric is to provide a sufficiently strong seam while maintaining a caliper similar to that of the main body of the base to prevent seam marking.

A further aspect of such a seamed press fabric is to have a fabric structure that does not collapse under load.

SUMMARY OF THE INVENTION

The present invention is a modified endless woven one-and-a-half layer monofilament fabric for use as a press fabric on a papermaking machine. This base fabric provides a solution to the problem of producing a low caliper seamed press fabric.

It is therefore a principal object of the invention to overcome the shortcomings of the fabrics heretofore mentioned.

It is a further object of the invention to provide a press fabric which allows for easy installation and seaming.

Accordingly, the present invention is a papermaker's fabric for use as a seamed press fabric on a papermaking machine. The fabric has a one-and-a-half layer fabric base of unstacked machine-direction (MD) wefts and cross-machine direction (CD) warps formed by a modified endless weaving process. The MD wefts and CD warps are monofilament yarns. The fabric has seaming loops oriented perpendicular to the plane of the fabric base for easier connection and seaming. The seam loops are formed from adjacent unstacked MD wefts in the fabric base. When the fabric is placed under load, the seam loops result in a seam having a seam caliper substantially similar to a caliper of the base fabric.

Other aspects of the present invention include that the seamed press fabric may be used for applications where a low caliper is desired and for example, where blowing is a problem. The adjacent unstacked MD wefts help to produce a larger "web cake" of needled batt fiber on top of the base than other fabrics having a similar caliper. The seam loops collapse from their perpendicular orientation back into the plane of the fabric base when under load to produce a seam having a seam caliper substantially similar to the caliper of the base fabric. The seam has a sufficient number of seam loops per linear area to result in a seam having relative strength comparable to double layer fabric seams. The MD wefts and CD warps may have a circular cross-sectional shape, a rectangular cross-sectional shape or a non-round cross-sectional shape.

BRIEF DESCRIPTION OF THE DRAWINGS

For a more complete understanding of the invention, reference is made to the following description and accompanying drawings, in which:

FIG. 1 is a schematic view showing the sheet contact or faceside (top) weave pattern for an exemplary fabric in accordance with the teachings of the present invention;

DETAILED DESCRIPTION OF THE PREFERRED EMBODIMENTS

Fabrics produced according to the present invention have a low caliper one-and-a-half layer base structure wherein the loops on both CD edges are canted at similar angles to allow for easy meshing (i.e. loop connection) and seaming. In the present invention, the seaming loops formed by the weft yarns are upright (i.e. perpendicular to) the fabric base to facilitate seaming, and are then allowed to fall back similar to the base fabric weft yarns alignment upon application of a load to the fabric even after meshing the loops together to form the seam. In other words, once a load is applied to the fabric, including the seam area, the seam has the same the low caliper of the body of base fabric.

FIG. 1 is a schematic view showing the sheet or face side (top) weave pattern for an exemplary fabric in accordance with the teachings of the present invention. The present invention is applicable to any weave pattern with unstacked MD yarns that form seam loops and should not be construed as being limited to the example shown. Accordingly, the example pattern shown in FIG. 1 is a modification of Albany International's 1040 staggered weave pattern. The 1040 weave has a 3 shed pattern, is typically woven on a 6 shed system, and produces a strong twill line. The example pattern modifies this 1040 weave to an 8 shed, 8 CD yarn pattern repeat and reduces the twill line. This modified fabric weave pattern retains sufficient flow resistance for use in applications where a low caliper and low void volume is desired such as a press where blowing is a problem. The following figures show modified endless woven fabric produced with this exemplary weave pattern.

Figure 2:
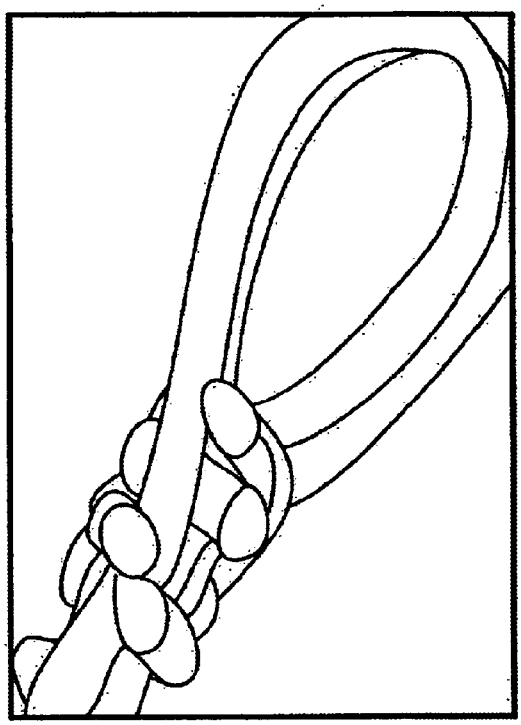
FIG. 2 is a composite scanning electron microscope (SEM) picture showing the seaming loops of a fabric woven in accordance with the teachings of the present invention.

FIG. 2 is a composite scanning electron microscope (SEM) picture of a cross-sectional CD view of a fabric woven using the pattern shown in FIG. 1 and showing the seaming loops in accordance with the teachings of the present invention. The loops are aligned in a direction perpendicular to the plane of the fabric surface. Note the size (or caliper) of the loops relative to the caliper (or thickness) of the fabric body in this unloaded/unseamed configuration. All yarns in this fabric are monofilaments.

Figure 3:
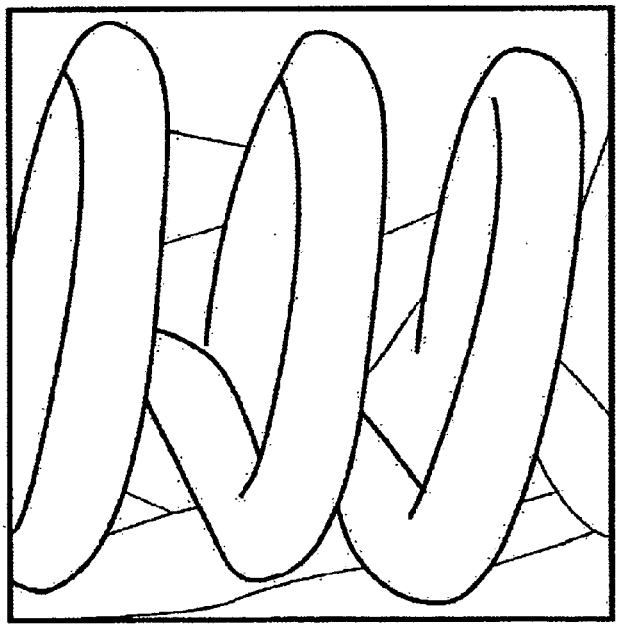
FIG. 3 is an end-on SEM picture showing the vertical orientation of the seaming loops relative to the body of a fabric woven in accordance with the teachings of the present invention.

FIG. 3 is an end-on SEM picture showing the vertical orientation of the seaming loops relative to the body of a fabric woven in accordance with the teachings of the present invention. These seaming loops can be easily interdigitated with corresponding loops at the other end of the fabric and seamed together by inserting a pintle through the loops. The caliper and alignment of the loops facilitates the seaming process.

Figure 4:
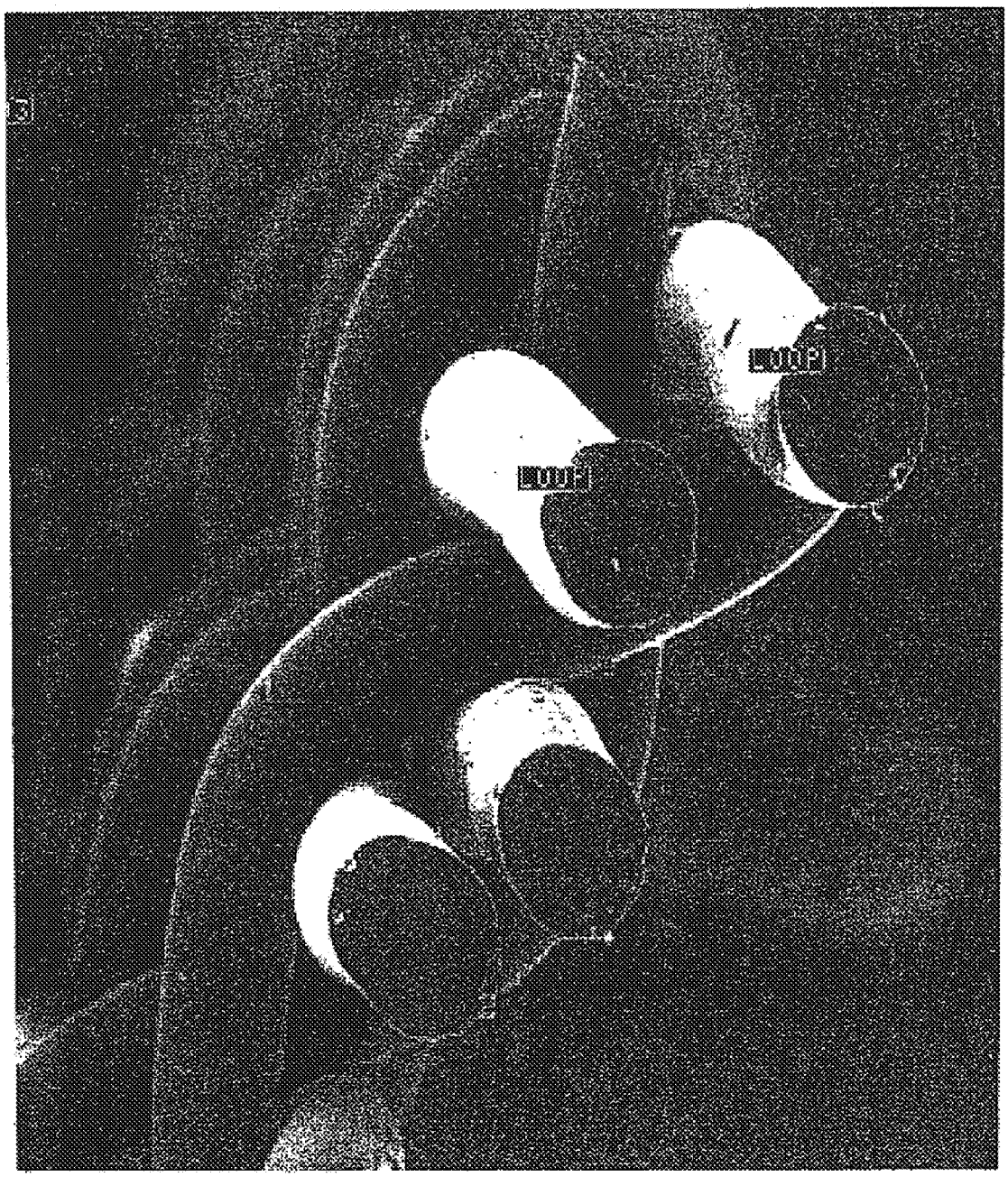
FIG. 4 is a cut-away SEM view showing the relative orientation of the seaming loop wefts as they leave and enter the body of a fabric woven in accordance with the teachings of the present invention.

FIG. 4 is an end-on SEM picture with the loops cut away to show the relative orientation of the seaming loop MD wefts as they enter the body of the fabric. The two yarns labeled "loop" come together to form a single loop; which in this view has been cut-away. These "loop" yarns are MD wefts formed during the modified endless weaving process. Importantly, the MD wefts are unstacked; meaning they are not vertically aligned perpendicular to the plane of the fabric. Whereas, prior art double layer fabrics use vertically stacked yarns to produce the loops. This unstacked configuration allows the loops to collapse/fold down when placed under load to a caliper substantially similar to that of the body of the base fabric.

Figure 5:
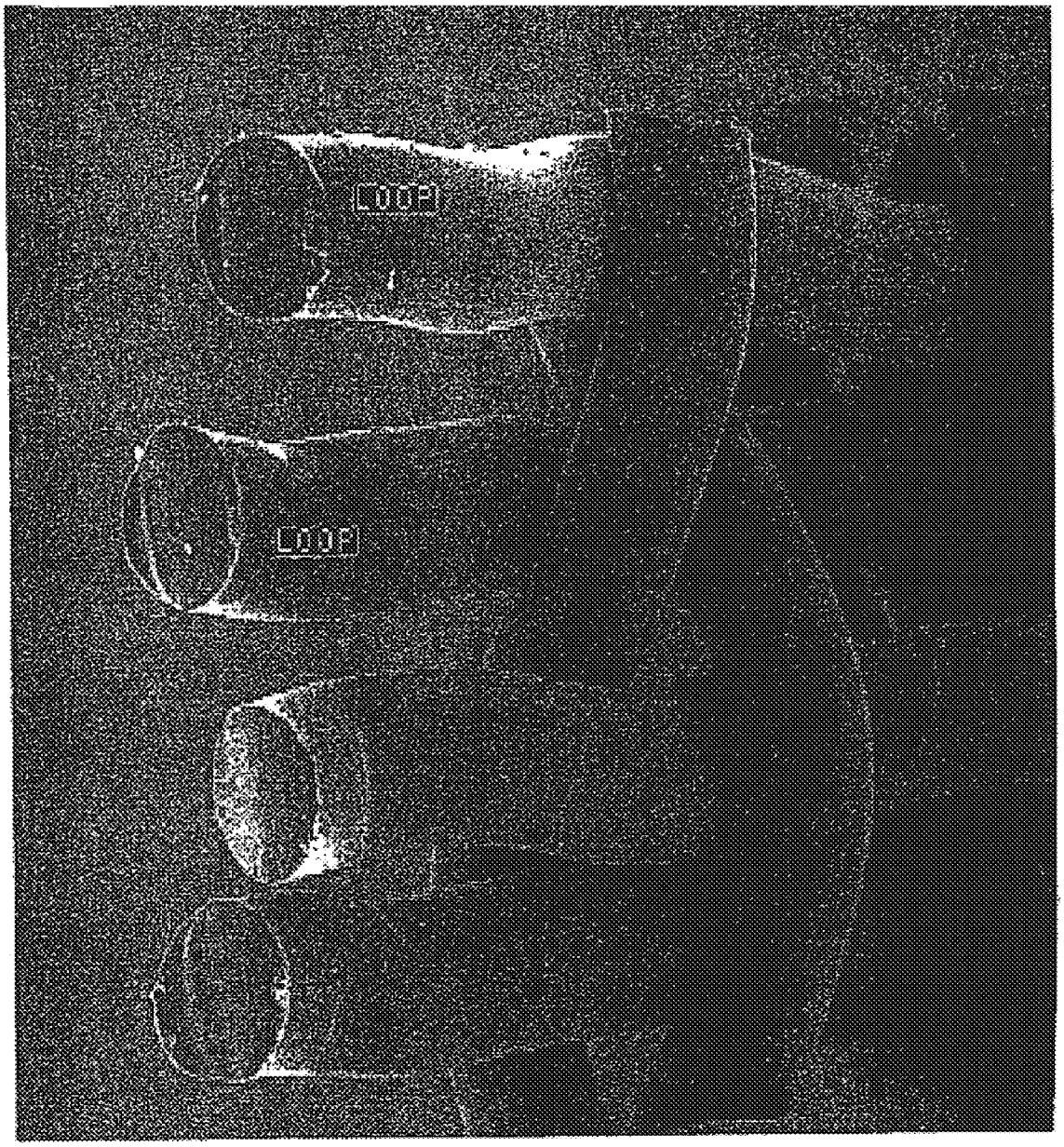
FIG. 5 is another cut-away SEM view showing the relative orientation of the seaming loop wefts in the body of a fabric woven in accordance with the teachings of the present invention.

FIG. 5 is another cut-away SEM view showing the relative orientation of the seaming loop MD wefts in the body of a fabric woven in accordance with the teachings of the present invention. Again, note the unstacked but adjacent configuration of the "loop" yarns.

In addition, since the fabric is a one-and-a-half layer fabric rather than a double layer fabric, the structure cannot collapse under load in the same manner as some double layer fabrics. This is especially true when the present fabric is constructed of all monofilament yarns.

A further advantage is that the present fabric structure tends to keep the needled batt fiber from being transporting into and through the base fabric. This reduced open area reduces fiber transfer during needling and thus allows a larger "web cake" to build above the plane of the base fabric than other fabrics having a similar caliper. A larger web cake is almost always advantageous to reduce both base and seam and marking.

The fabric according to the present invention preferably comprises only monofilament yarns. However, other yarn types such as plied or twisted monofilaments or multifilaments can be used as either MD or CD yarns. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. Thus, the present invention's objects and advantages are realized and although preferred embodiments have been disclosed and described in detail herein, their scope should not be limited thereby; rather their scope should be determined by that of the appended claims.

What is claimed is:

1. A papermaker's fabric for use as a seamed press fabric on a papermaking machine, comprising:

a one-and-a-half layer fabric base of unstacked machine-direction (MD) wefts and cross-machine direction (CD) warps formed by a modified endless weaving process; wherein the MD wefts and CD warps are monofilament yarns;

seam loops oriented perpendicular to the plane of the fabric base for easier connection and seaming; the seam loops being formed from adjacent unstacked MD wefts in the fabric base; and wherein the seam loops result in a seam having a seam caliper substantially similar to a caliper of the body of the base fabric when under load.

2. The papermaker's fabric according to claim 1, wherein the seam loops result in the seam having the seam caliper substantially similar to the caliper of the base fabric by collapsing from their perpendicular orientation back into the plane of the fabric base when under load.

3. The papermaker's fabric according to claim 1, wherein the seam has a sufficient number of seam loops per linear area to result in a seam strength comparable to double layer fabric seams.

4. The papermaker's fabric according to claim 1, wherein the MD wefts and CD warps have a circular cross-sectional shape, a rectangular cross-sectional shape or a non-round cross-sectional shape.

5. The papermaker's fabric according to claim 1, wherein the MD wefts and/or CD warps are plied monofilaments or multifilaments.

* * * * *